US008181896B1

(12) United States Patent
Scribner

(10) Patent No.: US 8,181,896 B1
(45) Date of Patent: May 22, 2012

(54) MARKING OFF TAPE ASSEMBLY

(76) Inventor: Patrick L. Scribner, Columbia Falls, MT (US)

( * ) Notice: Subject to any disclaimer, the term of this patent is extended or adjusted under 35 U.S.C. 154(b) by 743 days.

(21) Appl. No.: 12/208,461

(22) Filed: Sep. 11, 2008

(51) Int. Cl.
*B65H 18/28* (2006.01)

(52) U.S. Cl. ..... 242/160.4

(58) Field of Classification Search ..... 242/159, 242/160.1, 423, 423.1, 160.3, 160.4
See application file for complete search history.

(56) References Cited

U.S. PATENT DOCUMENTS

| | | | | |
|---|---|---|---|---|
| 440,828 | A | 11/1890 | Jerome | |
| 459,516 | A | 9/1891 | Wheeler | |
| 498,869 | A | 7/1892 | Jerome | |
| 2,303,144 | A | 11/1942 | Stephenson | |
| 2,508,855 | A | 5/1950 | Brown | |
| 2,780,352 | A * | 2/1957 | Schroeder | 206/389 |
| D297,596 | S | 9/1988 | Marquart, Sr. | |
| 5,153,043 | A | 10/1992 | Wang | |
| 5,616,387 | A | 4/1997 | Augst et al. | |
| 5,799,577 | A * | 9/1998 | Takahashi | 101/127 |
| 7,367,520 | B2 * | 5/2008 | Neveu | 242/160.1 |

* cited by examiner

*Primary Examiner* — William A Rivera

(57) ABSTRACT

A marking off tape assembly includes an elongated and flexible panel that is comprised of a plastic material. The panel is wound upon a cylinder to form the panel into a cylindrical shape having a first lateral edge and a second lateral edge. At least one melt line is formed in the first lateral edge and melting together the layers of the panel. The melt line extends from the cylinder to an outer edge defined by the cylindrical shape. The melt line prevents the panel from unwanted unwinding from the cylinder.

3 Claims, 3 Drawing Sheets

MARKING OFF TAPE ASSEMBLY

BACKGROUND OF THE INVENTION

Field of the Invention

The present invention relates to cordoning tape devices and more particularly pertains to a new cordoning tape device which does not easily unwind itself from a wound condition.

SUMMARY OF THE INVENTION

The present invention meets the needs presented above by generally comprising an elongated and flexible panel that is comprised of a plastic material. The panel is wound upon a cylinder to form the panel into a cylindrical shape having a first lateral edge and a second lateral edge. At least one melt line is formed in the first lateral edge and melting together the layers of the panel. The melt line extends from the cylinder to an outer edge defined by the cylindrical shape. The melt line prevents the panel from unwanted unwinding from the cylinder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
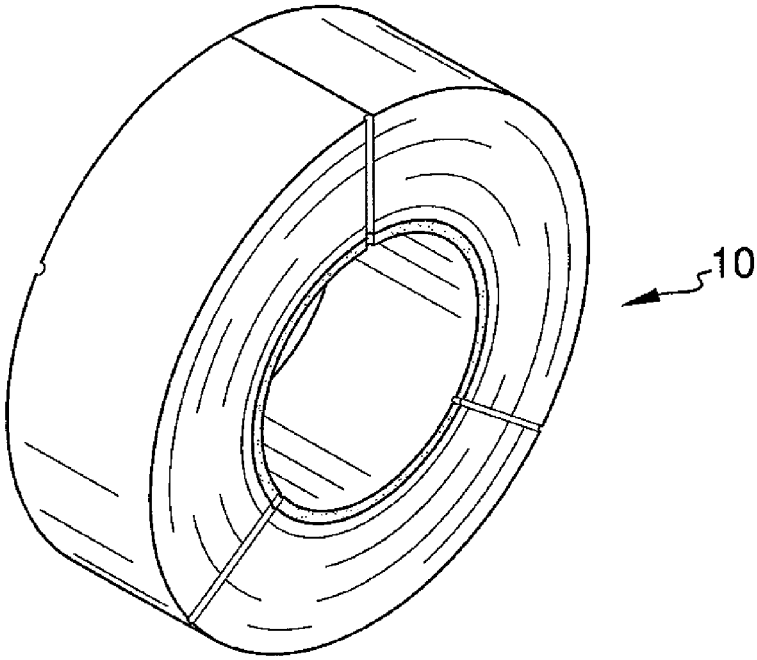
FIG. 1 is a top perspective view of a marking off tape assembly according to the present invention.
Figure 2:
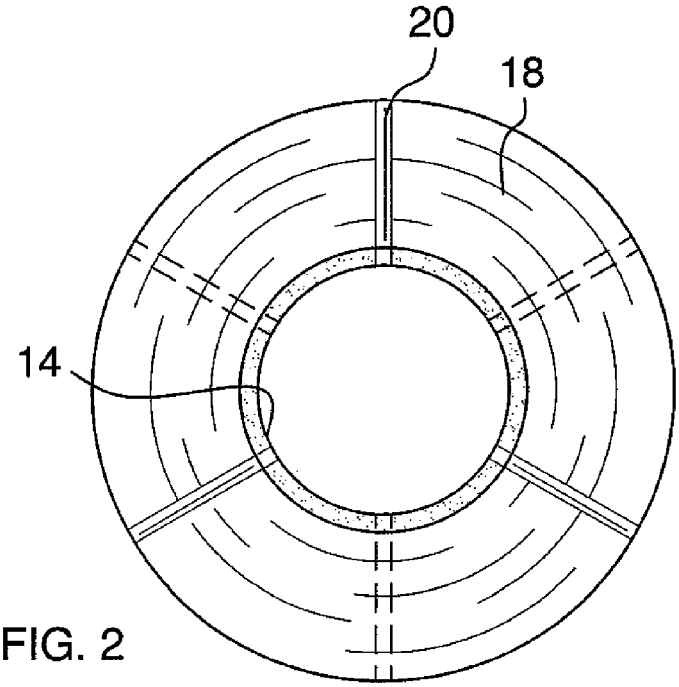
FIG. 2 is a side view of the present invention.
Figure 3:
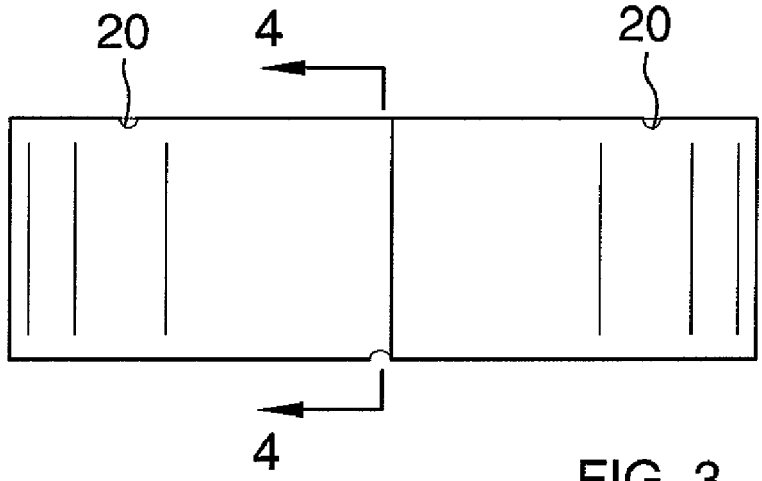
FIG. 3 is a top view of the present invention.
Figure 4:
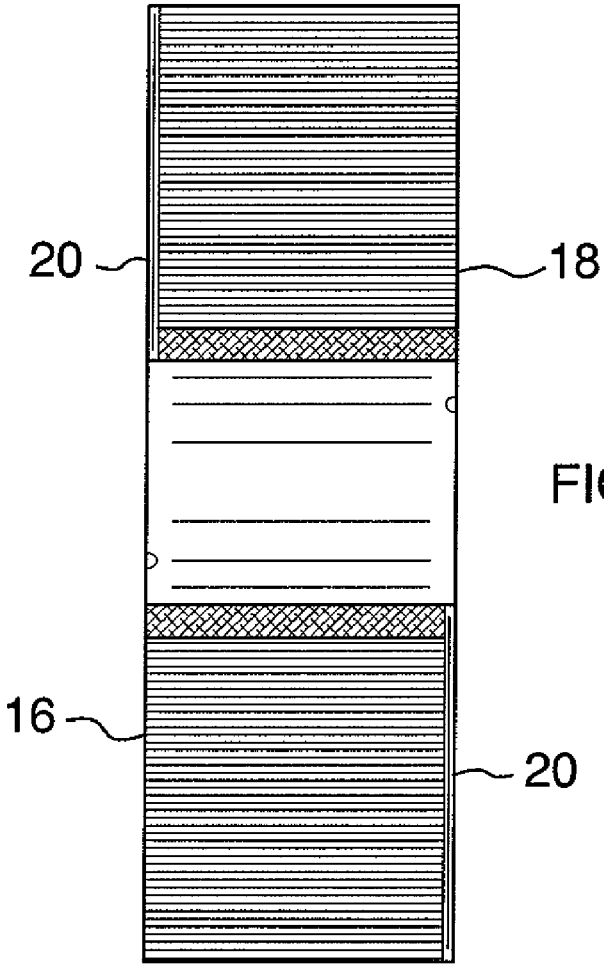
FIG. 4 is a cross-sectional view taken along line 4-4 of FIG. 3 of the present invention.
Figure 5:
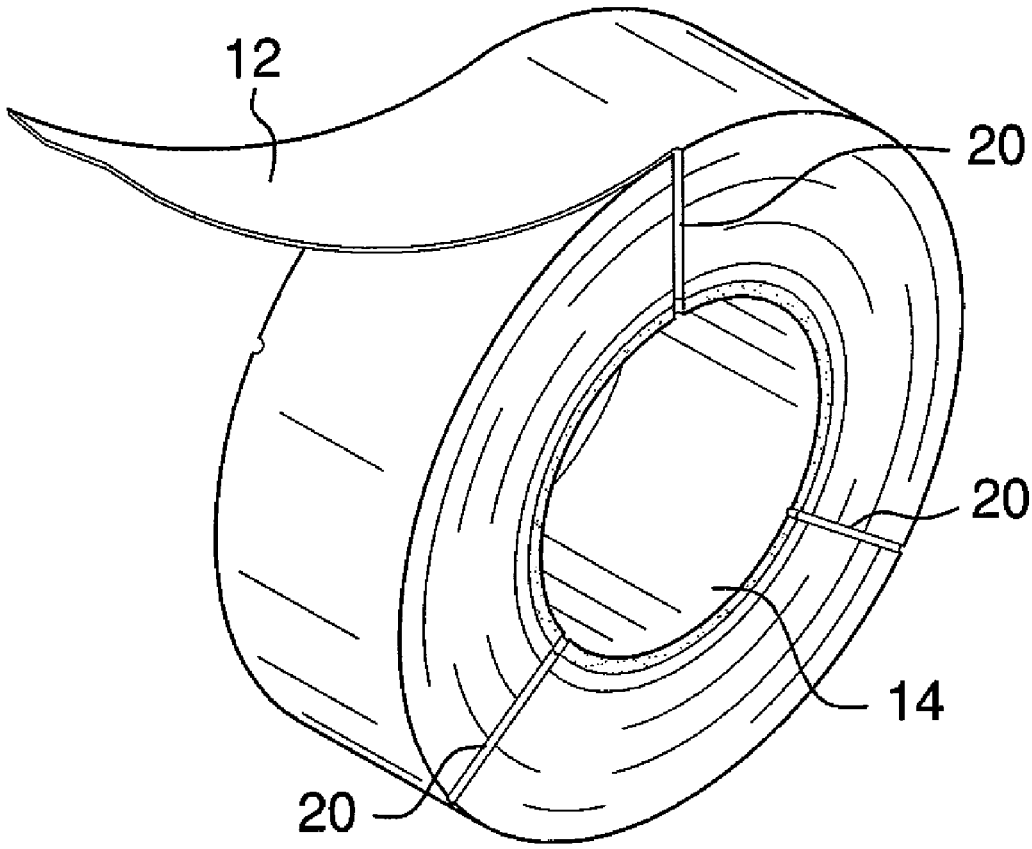
FIG. 5 is a top perspective view of the present invention.

With reference now to the drawings, and in particular to FIGS. 1 through 5 thereof, a new cordoning tape device embodying the principles and concepts of the present invention and generally designated by the reference numeral 10 will be described.

As best illustrated in FIGS. 1 through 5, the marking off tape assembly 10 generally comprises an elongated and flexible panel 12. The panel 12 is comprised of a plastic material. The panel 12 is conventional to cordoning tape used for delineating an area such as that used by police offices, firefighters, utility workers, surveyors, construction workers and the like.

A cylinder 14 is provided and the panel 12 is wound upon the cylinder 14 to form the panel 12 into a cylindrical shape that has a first lateral edge 16 and a second lateral edge 18. A plurality of melt lines 20 is formed in the first 16 and second 18 lateral edges. This may be done using any conventional manner of applying heat to the first 16 and second 18 lateral edges to melt the layers of the panel together. The melt lines each have a width of less than 1/25 of a circumference of an outer edge of the cylinder 14. The melt lines 20 extend from the cylinder 14 to an outer edge defined by the cylindrical shape. The melt lines 20 prevent the panel 12 from unwanted unwinding from the cylinder.

In use, the panel 12 is used in a conventional manner and unwound from the cylinder 14 by pulling with sufficient force to break the melt lines as the panel 12 is unwound. However, when the panel 12 is not being pulled relative to the cylinder 14, the melt lines 20 prevent the panel 12 from spontaneously unwinding which can tangle the panel 12 and also waste elongated portions of the panel 12. The panel 12 is also easier to manipulate while being unwound from the cylinder 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A marking tape assembly comprising:

an elongated and flexible panel, said panel being comprised of a plastic material; and a cylinder, said panel being wound upon said cylinder to form said panel into a cylindrical shape having a first lateral edge and a second lateral edge, at least one melt line being formed in said first lateral edge and melting together layers of said panel, said melt line extending from said cylinder to an outer edge defined by said cylindrical shape, said melt line preventing said panel from unwanted unwinding from said cylinder.

2. A marking tape assembly comprising:

an elongated and flexible panel, said panel being comprised of a plastic material; and a cylinder, said panel being wound upon said cylinder to form said panel into a cylindrical shape having a first lateral edge and a second lateral edge, a plurality of melt lines being formed in said first and second lateral edges and melting layers of said panels together, said melt lines extending from said cylinder to an outer edge defined by said cylindrical shape, said melt lines preventing said panel from unwanted unwinding from said cylinder.

3. A method of preventing the unwinding of a marking tape assembly, said method comprising the steps of:

providing an elongated and flexible panel, said panel being comprised of a plastic material, providing a cylinder;

winding said panel upon said cylinder to form said panel into a cylindrical shape having a first lateral edge and a second lateral, edge;

forming melt lines in said first and second lateral edges extending from said cylinder to an outer edge defined by said cylindrical shape to melt layers of said panel together, said melt lines preventing said panel from unwanted unwinding from said cylinder.

* * * * *